United States Patent [19]

Jütte et al.

[11] 4,063,425

[45] Dec. 20, 1977

[54] TUNNEL DRIVING APPARATUS

[75] Inventors: Hans Jütte, Dortmund-Brechten; Dieter Stuckmann, Selm, both of Germany

[73] Assignee: Gewerkschaft Eisenhutte Westfalia, Westfalia, Germany

[21] Appl. No.: 748,313

[22] Filed: Dec. 7, 1976

[30] Foreign Application Priority Data

Dec. 9, 1975 Germany ..... 2555317

[51] Int. Cl.[2] ..... E01G 3/02

[52] U.S. Cl. ..... 61/85; 61/42; 61/84

[58] Field of Search ..... 61/85, 84, 42, 45 R, 61/45 D, 45 C, 63; 299/31, 33, 11

[56] References Cited

U.S. PATENT DOCUMENTS

| | | | |
|---|---|---|---|
| 834,745 | 10/1906 | Moir | 61/85 |
| 1,275,910 | 8/1918 | Hamilton | 61/85 |
| 1,855,466 | 4/1932 | Barber et al. | 61/85 |
| 3,581,507 | 6/1971 | Stevens | 61/85 |
| 3,998,067 | 12/1976 | Fernandez | 61/85 |

*Primary Examiner*—Dennis L. Taylor

*Attorney, Agent, or Firm*—Thompson, Birch, Gauthier & Samuels

[57] ABSTRACT

A shield for tunnel driving operations comprises a plurality of elongate drive members supporting the tunnel wall at a forward region and carried by a frame. Rams serve to advance the members individually, or in groups, and to shift up the frame. Each drive member has a rear extension plate or tail extending rearwardly of the tunnel driving direction. Lining elements are assembled within a chamber defined by the tails and a space between the assembled elements and the inner surfaces of the tails is filled as the tunnel advances to create a permanent lining. The space is sealed off with the aid of seals effective between the longitudinal edges of the tails and with a radial seal or the like between the lining elements and the tails.

16 Claims, 10 Drawing Figures

FIG.1
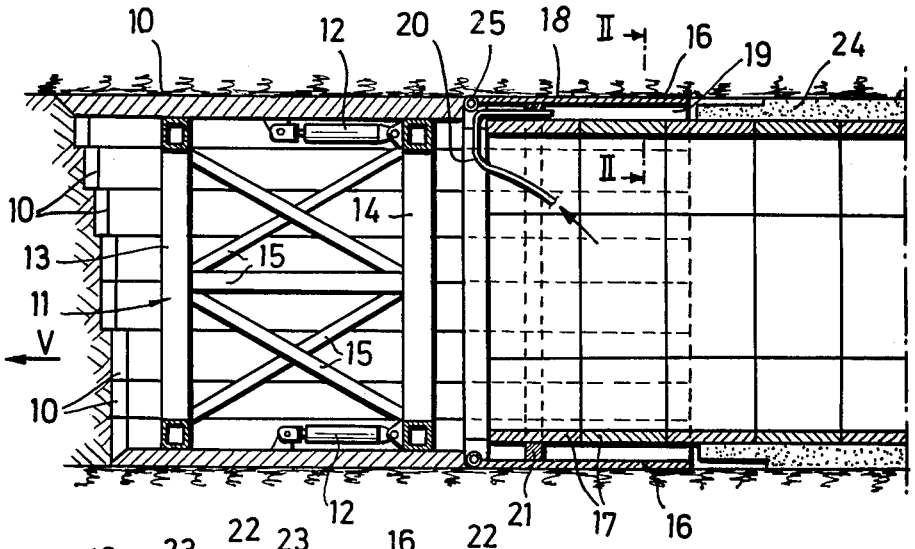
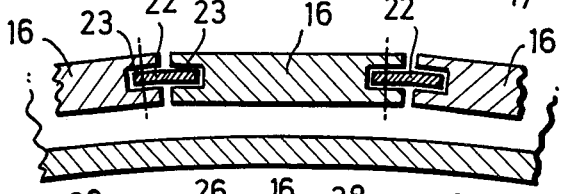
FIG.2
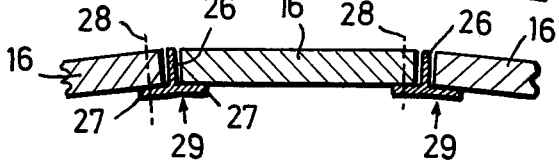
FIG.3
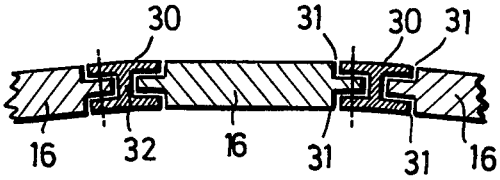
FIG.4
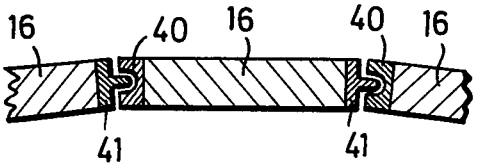
FIG.5
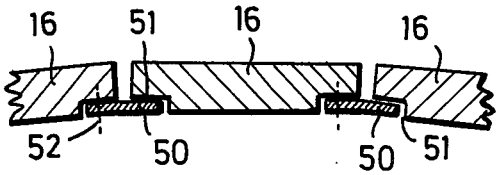
FIG.6

TUNNEL DRIVING APPARATUS

BACKGROUND TO THE INVENTION

The present invention relates in general to apparatus for use in driving tunnels, trenches, galleries, adits and similar excavations collectively referred to for convenience throughout this specification and claims as "tunnels." More particularly, however, the invention is concerned with a shield for use in such apparatus.

It is well known to utilize a shield in tunnel driving operations which shield employs a series of drive members disposed side-by-side in parallel configuration and supported on a frame. These members are then driven forwards by shifting rams and the frame thereafter drawn up. In order to create a permanent tunnel lining supporting the tunnel wall behind the shield it is also known to provide the drive members with rear extensions which define a rear shield into which lining elements can be placed prior to supporting the wall of the tunnel exposed when the drive members are advanced.

As the rear extensions or tails are moved up to follow their drive members a gap is inevitably left between the tunnel wall and the lining elements and partial collapse of the tunnel wall and/or settlement can occur. Also the lining elements can become inadequately supported and their stability suffers. Various measures can be adopted to avoid these problems, for example, a filling material such as fluid concrete can be injected into the gaps left by the advancing tails. High pressures are usually necessitated however and the filling material is thus prone to be forced into unwanted regions. Also where tunnel driving occurs in water-laden soil pressurized air is often used to keep out the leaking water and high losses of air occur from the rear shield.

SUMMARY OF THE INVENTION

A general object of the present invention is to provide an improved shield for use in tunnelling.

In one aspect the invention provides a tunnel driving apparatus comprising a shield with a series of elongate drive members arranged side-by-side in parallel relationship, a frame supporting the drive members for alternately advancing the drive members and the frame, a rear extension forming a tail provided for each drive member, the tails being relatively shiftable in accordance with the tunnel advancement and serving to define a reception zone for lining elements spaced from the tunnel wall and from the inner surfaces of the tails and sealing means for sealing off the space between the inner surfaces of the tails and the lining elements whereby to permit a filling material to be introduced into said space as the tunnel advances to create a permanent tunnel lining.

By employing sealing means in accordance with the invention the difficulties discussed above can be mitigated.

In a preferred form the sealing means includes at least seals between the longitudinal edges of the tails. One or more transverse seals engaging between the lining elements and the tails and extending across the tails can also be adopted. One form of transverse seal is a sealing ring located near the frame and permitting the ingress of the filling material. Such a ring can also perform a support or bracing function and a particularly useful design uses an expandible ring—for example a hollow or partly hollow ring which can be inflated. The sealing ring or a support therefor is preferably capable of being shifted independently of the drive members and their tails and the ring or its support can be connected to move with the frame either directly or indirectly.

As is known, the lining elements which combine with the filling material to produce a permanent lining can be light-weight tubes or arcuate segments.

It is generally desirable to make the sealing means from a flexible preferably resilient material such as rubber or synthetic plastics.

Grooves or recesses or the like can be provided in the tails. The longitudinal seals effective between the edges of the tails may project beyond the inner surfaces of the tails, to engage the lining elements.

The invention also extends to a special drive member and rear extension plate or tail for use in a shield made in accordance with the invention. The drive member is characterized by a sealing element provided on one of the longitudinal edges of its rear rail. Additional transverse sealing elements can also be provided on the inner surfaces of the tails and here it is desirable to make the longitudinal elements project beyond the inner surfaces of the tails and have surfaces flush with those of the transverse elements.

The invention may be understood more readily and various other features of the invention may become more apparent from consideration of the following description.

BRIEF DESCRIPTION OF DRAWINGS

Embodiments of the invention will now be described, by way of examples only, with reference to the accompanying drawings, wherein:

FIG. 1 is a schematic sectional view of a tunnel driving apparatus made in accordance with the invention;

FIGS. 2 to 7 are enlarged sectional end views of part of the shield of the apparatus showing various sealing arrangements;

DESCRIPTION OF PREFERRED EMBODIMENTS

Figure 8:
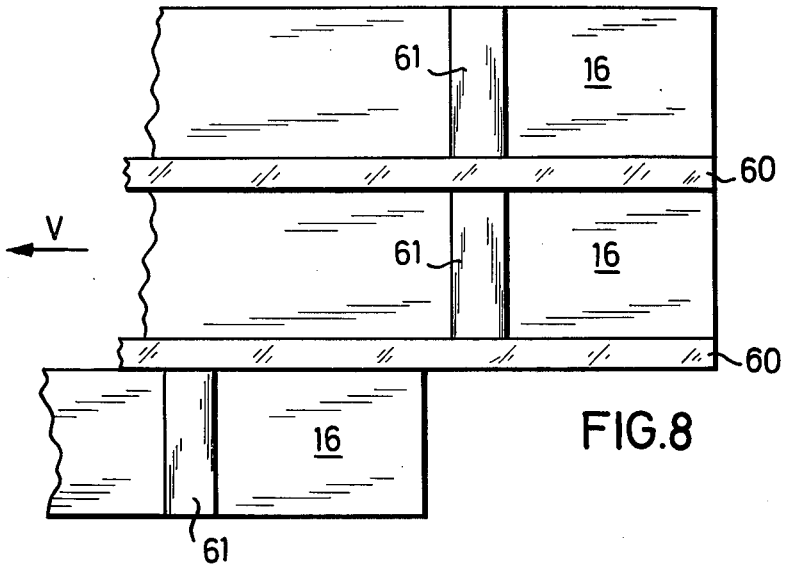
FIG. 8 is a schematic inverted plan view of the shield part represented in FIG. 7.

Referring to FIG. 1, a tunnel driving apparatus employs a shield composed of a number of elongate drive members or planks 10 arranged side-by-side in parallel relationship in contact with the tunnel wall. As is known the members 10 are supported for individual longitudinal displacement on a frame 11. Hydraulic rams 12 are interconnected between the frame 11 and the members 10. The rams 12 are double-acting and serve to alternatively advance the members 10 and the frame 11. In this construction each member 10 has a ram 12 allocated to it although each ram 10 could operate a group of members 10 if desired. The frame 11 itself is constructed from two ring components 13, 14 rigidly interconnected by a bracing structure 15. The rams 12 are articulated to the rear component 14 and to the members 10. During use and in known manner, the rams 12 are operated, i.e., extended, singly or in groups to advance the associated member 10 or members 10 in the advancing direction V. When all the members 10 have been advanced the frame 11 is drawn up by retracting the rams 10 in unison.

The individual members 10 are provided with rear plate extensions referred to hereinafter as tails 16 which serve to protect the critical region between the rear of the main shield 10, 11 and the permanent tunnel lining. The tails 16 combine to form a cylindrical array or rear shield and are of reduced cross-section in relation to the members 10. As shown in FIG. 1, lining elements 17 can be introduced into the chamber protected inside the tails 16. Preferably the elements 17 are light-weight segments or sections bolted or otherwise affixed together.

The tails 16 are connected, for example, pivotably as at 25, to their associated members 10 so that as the members 10 are advanced the tails 16 follow up. As the tails 16 are thus shifted the lining elements 17 emerge from the rear to protect and support the exposed tunnel wall. Gaps or spaces 19 are however present at the exterior of the lining elements 17 and unless special measures are taken the tunnel wall can collapse partially leading to settlement and other difficulties. In order to preclude this the spaces 19 are filled with a material, preferably a self-hardening material such as concretious grouting. It is convenient to utilize fluid concrete under pressure for this purpose and this can be introduced into the spaces 19 via a feed line 20. In order to delimit the spaces 19 in the forward sense and avoid undesirable ingress of the filling material to the forward working zone or elsewhere sealing means is provided.

In FIG. 1, a sealing ring 21 is provided between the lining elements 17 and the interiors of the tails 16. In FIG. 2, longitudinal seals 22 are provided between adjacent tails 16. The sealing ring 21 and the seals 22 are preferably made from a flexible or synthetic plastics. As shown in FIG. 2, the seals 22 are of flat plate-like form and engage in grooves 23 provided in the longitudinal side edges of the tails 16. It can be arranged that each tail 16 carries one seal 22 fitted into one of its grooves 23 while the other groove 23 slidably receives the seal 22 of the next-adjacent tail 16. The seals 21, 22 maintain the desired sealing but do not interfere with the movement of the tails 16. The sealing ring 21 can be free, i.e., not attached to any other part as represented or movable or e.g., coupled through mechanical rods or hydraulic piston and cylinder units to the frame 11. In this way the ring 21 will be drawn up with the frame 11 and in the case where hydraulic units are used the ring 21 can be adjusted, if desired, by sliding on the elements 17. It would also be feasible to fix the sealing ring 21 onto the innermost elements 17 and here it may be preferable to provide the individual innermost elements with arcuate strips which combine to form the ring 21.

As shown in FIG. 1, the line 20 passes through the sealing ring 21 to terminate in the chamber defined by the spaces 19. As mentioned fluid concrete under pressure can be conveyed along the line and the subsequent hardened material is designated by reference numeral 24 in FIG. 1.

As can be appreciated the fluid concrete introduced fills the entire space between the elements 17 and the tunnel wall and prevents settlement and the like.

The sealing ring 21 can be constructed in a manner such that it can be expanded or stretched radially against the inner surfaces of the tails 16. In this design the ring 21 can be hollow or part hollow and fitted with a connector for introducing pressure fluid such as compressed air into the ring 21. In this way the elements 17 will be braced against the tails 16 and reliable sealing will be accomplished. Where the tails 16 are pivoted to the members 10 with the pivot joints 25 as represented in FIG. 1, the tails 16 will be swivelled against the tunnel wall by the expansion of the ring 21. An expandible ring 21 can be carried by a firm support if desired. Nevertheless, such bracing functions can be achieved without the ring 21 by the use of other devices such as hydraulic units or mechanical wedges or the like. Such devices can act on the elements 17 to cause the tails 16 to be urged against the tunnel wall through the intermediary of the ring 21.

FIGS. 3 to 10 depict various other types of sealing arrangements for sealing the tails 16 one to another. Thus, in FIG. 3 T-shaped sealing strips 29 are provided which have webs 26 engaging between the edges of adjacent tails 16 and flanges 27 resting on the undersides of the tails 16. One part of each flange 27 of each seal 29 may be secured to one of the associated tails 16 as represented by numeral 28 so that each tail 16 carries one of the seals 29.

In FIG. 4, H-shaped seals 30 are used. The longitudinal edges of the tails 16 are recessed as at 31 to receive the flanges of the seals 30 while the webs 32 of the seals 30 locate between the edges themselves. Again each seal 30 can be secured to one of the associated tails 16 so that each tail 16 carries one of the seals 30.

In the arrangement shown in FIG. 5, each seal is a multi-part construction and complementary sealing strips 40, 41 are provided at the longitudinal edge of the tails 16. No shaping of the tails 16 is necessary since the strips 40, 41 are provided with interengaging projections and recesses. Each tail 16 would thus have a recessed strip 40 secured to one side edge and a profiled strip 41 secured to its other side edge.

As shown in FIG. 6, flat plate-like seals 50 engage in recesses 51 provided at the junctures between the side edges and inner face of each tail 16. Each seal 50 is secured to one of the associated tails 16, as represented by numeral 52, so that each tail 16 again carries one seal 50.

Figure 7:
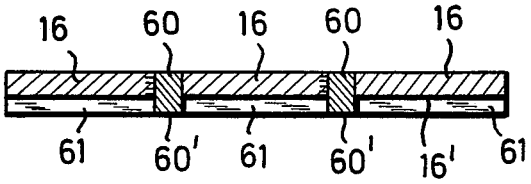

In the arrangements shown in FIGS. 7 and 8, longitudinal sealing elements 60 are arranged between the adjacent tails 16 and project beyond the undersurface 16' of the associated tails 16. Transverse sealing elements 61 extend across the undersurfaces 16' of the tails 16. The lower surfaces 60' of the elements 60 are aligned with the lower surfaces 61' of the elements 61 so that all the sealing elements 60, 61 can engage in common on the lining elements 17 and maintain their sealing action when the tails 16 are shifted. The individual elements 61 are preferably secured to the edge of one of the associated tails 16 so that each tail 16 carries one element 61. The elements 60, 61 are preferably interconnected so that each element 60 carries one element 61 with the elements 61 extending in the same direction.

Figure 9:
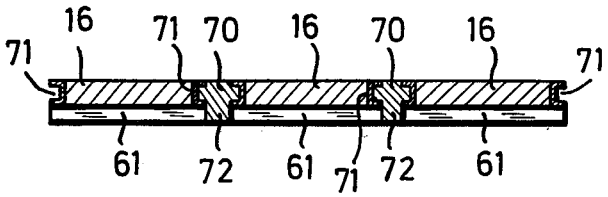
FIGS. 9 and 10 are enlarged sectional end views of part of the shield of the apparatus corresponding to FIGS. 2 to 7 and depicting further forms of sealing arrangements.

The arrangement depicted in FIG. 9 differs from that shown in FIGS. 7 and 8 essentially only in that the sealing elements 60 of FIGS. 7 and 8 are here replaced by T-shaped elements 70. The flanges of these elements 70 engage in grooves 71 at the longitudinal edges of the tails 61 and their webs 72 project beyond the undersurface of the tails and adjoin the flush transverse elements 61. The grooves 71 can be formed by attached profiled strips on the edges of the tails 16 and again the elements 70 would each be affixed to one of the associated tails 16.

Figure 10:
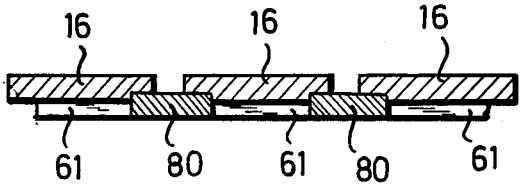

In FIG. 10 a further modified arrangement utilizes plate-like elements 80 as longitudinal seals. These elements 80 seat in recesses formed at the junctures between the undersurfaces and side edges of the tails 16. Again each element 80 would be secured to one of the tails 16 and the undersurfaces of the elements 80, 61 are flush.

Various other profiles can be adopted for the seals. For example, the form of seal shown in FIGS. 3 and 4 can be employed in the arrangements shown in FIGS. 7 to 10 by extending the longitudinal sealing elements beyond the undersurfaces of the tails 16.

We claim:

1. A tunnel driving apparatus comprising a shield with a series of elongate drive members arranged side-by-side in parallel relationship, a frame supporting the drive members for individual longitudinal displacement, means for alternately advancing the drive members and the frame, a rear extension forming a tail provided for each drive member, the tails being relatively shiftable in accordance with the tunnel advancement and serving to define a reception zone for lining elements spaced from the tunnel wall and from the inner surfaces of the tails and sealing means for sealing off the space between the inner surfaces of the tails and the lining elements whereby to permit a filling material to be introduced into said space as the tunnel advances to create a permanent tunnel lining.

2. An apparatus according to claim 1, wherein the sealing means at least includes seals between the longitudinal edges of the tails.

3. An apparatus according to claim 2, wherein the sealing means further comprises at least one seal extending transversely of each of the tails.

4. An apparatus according to claim 1 wherein the sealing means is made from a flexible material.

5. An apparatus according to claim 2, wherein the seals between the longitudinal edges of the tails project beyond the inner surfaces of the tails.

6. An apparatus according to claim 1, wherein the tails are provided with grooves and the sealing means engage in said grooves.

7. An apparatus according to claim 1, wherein the tails are provided with recesses and the sealing means engages in said recesses.

8. An apparatus according to claim 1, wherein the sealing means comprises individual sealing elements each fixed to one of the tails and serving to seal said one tail in relation to an adjacent tail.

9. An apparatus according to claim 1, wherein the sealing means includes a separate sealing ring located generally between the inner surfaces of the tails and the lining elements.

10. An apparatus according to claim 9, wherein the sealing ring is movable independently of the drive members and the tails.

11. An apparatus according to claim 9, wherein the sealing ring is connected for movement with the frame.

12. An apparatus according to claim 9, wherein the sealing ring is capable of expansive movement between the lining elements and the tails.

13. An apparatus according to claim 12, wherein the sealing ring is at least partly hollow and has means for admitting pressure fluid to effect its expansion.

14. An apparatus according to claim 1, wherein the tails are pivotably connected to the drive members.

15. An apparatus according to claim 1 and further comprising means for providing said filling material under pressure.

16. A shield for use in tunnel driving operations comprising a series of elongate individually movable drive members arranged side-by-side in parallel relationship, a frame supporting the drive members, shifting means coupled between the drive members and the frame for alternately advancing the drive members and the frame, a rear extension provided on each drive member, the rear extension combining to define therein a rear zone, tunnel lining elements arranged in said rear zone and spaced from the inner surfaces of the rear extensions, longitudinal seals between the longitudinal edges of the rear extensions, a further seal between the inner surfaces of the rear extensions and the lining elements and means for introducing a filling material into the space between the lining element and the inner surfaces of the rear extensions, the filling material combining with the lining elements to produce a permanent lining supporting the tunnel wall and being prevented from overflow by said seals.

* * * * *